US005350880A

United States Patent [19]

Sato

[11] Patent Number: 5,350,880

[45] Date of Patent: Sep. 27, 1994

[54] APPARATUS FOR VARYING THE SOUND OF MUSIC AS IT IS AUTOMATICALLY PLAYED

[75] Inventor: Takehisa Sato, Hamamatsu, Japan

[73] Assignee: Kabushiki Kaisha Kawai Gakki Seisakusho, Hamamatsu, Japan

[21] Appl. No.: 960,666

[22] Filed: Oct. 14, 1992

Related U.S. Application Data

[63] Continuation of Ser. No. 779,423, Oct. 17, 1991, abandoned.

[30] Foreign Application Priority Data

Oct. 18, 1990 [JP] Japan ..... 2-277889

[51] Int. Cl.[5] ..... G10H 1/057; G10H 1/06; G10H 1/40

[52] U.S. Cl. ..... 84/609; 84/611; 84/622; 84/627; 84/DIG. 12

[58] Field of Search ..... 84/601-646, 84/DIG. 12, DIG. 22

[56] References Cited

U.S. PATENT DOCUMENTS

| | | | |
|---|---|---|---|
| 4,128,032 | 12/1978 | Wada et al. | 84/604 |
| 4,618,851 | 10/1986 | Watanabe | 84/609 X |
| 4,881,440 | 11/1989 | Kakizaki | 84/609 |
| 4,916,996 | 4/1990 | Suzuki et al. | 84/603 |
| 5,239,124 | 8/1993 | Eitaki et al. | 84/634 |

*Primary Examiner*—Stanley J. Witkowski

*Attorney, Agent, or Firm*—Joseph C. Mason, Jr.; Ronald E. Smith

[57] ABSTRACT

An automatic playing apparatus which reads tone information from a ROM piece by piece to play a demonstration. The tone information stored in the ROM includes note data for generation of a musical tone as well as data for changing the parameters of music corresponding to the note data. When a demonstration is played, the note data and the data for changing the music parameters stored in the ROM are read out piece by piece, and the associated musical tones are generated accordingly. In this way, the musical piece being automatically played changes with each repetition, so that listeners hear a different version of the piece each time it is re-played.

7 Claims, 5 Drawing Sheets

APPARATUS FOR VARYING THE SOUND OF MUSIC AS IT IS AUTOMATICALLY PLAYED

CROSS-REFERENCE TO RELATED DISCLOSURES

This application is a continuation of a now-abandoned disclosure bearing Ser. No. 07/779,423, filed 10/17/91 by the same inventor now abandoned.

BACKGROUND OF THE INVENTION

1. Field of the Invention

The present invention relates to an automatic playing apparatus for use in an electronic musical instrument, such as a synthesizer, an electronic piano or an electronic Organ.

2. Description of the Prior Art

An electronic musical instrument generally has an automatic playing apparatus incorporated therein. When a player does not play the electronic musical instrument, therefore, a predetermined demonstration (hereafter referred to simply as "demo") is played by the automatic playing apparatus.

In order to play such a demo, demo data in a predetermined format, corresponding to a given piece of music, is previously stored in a read only memory (hereafter referred to as "ROM"), and then is read piece by piece to generate musical tones.

Demo data to be used in a conventional automatic playing apparatus has multiple pieces of note data consisting of the minimum information necessary for tone generation.

The piece of note data in demo data consists of, for example, a key number, a step time, a gate time, a TAG and a velocity.

The "key number" corresponds to a number given to each key on a keyboard, and is used to specify a tone pitch. The "step time" indicates the time length from a key-ON time for the previous note data to a key-ON time for the current note data, and is used to specify a tone-ON timing.

The "gate time" indicates the time length from a key-ON time to a key-OFF time. The "velocity" is data for specifying the key-operation speed or key-hitting strength, and serves to indicate the strength of a tone to be generated. The "TAG", data relating to a playing pattern, is used to alter the rhythm.

To play a demonstration, the demo data, or a group of note data including the above-described elements, is read out from the ROM and supplied to a tone preparing circuit (tone generator), so that a predetermined piece of music is automatically played.

When the demo data is read out from the beginning to the end to generate the associated musical tones, playing a demo of one music piece is then completed. When the demo of one music piece is ended, the demo data may be sequentially read again from the beginning to generate the musical tones, thereby ensuring repetitive playing of the same music.

Such conventional demo playing is however monotonous because a single piece of music is repetitively played with the same timbre and at the same tempo, causing listeners to be bored.

It should be understood that music creates a certain image in the mind of the listener. Of course, the same music may create different mental images in the minds of different listeners. However, the same piece of music, if re-played the same way over and over, will create the same image over and over for each listener if the effects of boredom are discounted.

SUMMARY OF THE INVENTION

It is therefore an object of the present invention to provide an automatic playing apparatus which can alter the timbre and rhythm at a given timing to vary the image of music and remove the monotony of the music.

To achieve this object, according to the present invention, an automatic playing apparatus for playing a demonstration comprises storage means for storing tone information including note information and information for altering an image of music; and control means for sequentially reading out the tone information from the storage means and subjecting the read tone information to a tone-ON process to thereby play the demonstration while changing the image of music based on the music image altering information.

According to the present invention, information for changing the music image is stored in advance as demo data in the storage means in addition to note information, and musical tones are generated, referring to this music-image altering information. It is therefore possible to play varied demonstrations without monotony.

DETAILED DESCRIPTION OF THE PREFERRED EMBODIMENT

Figure 1:
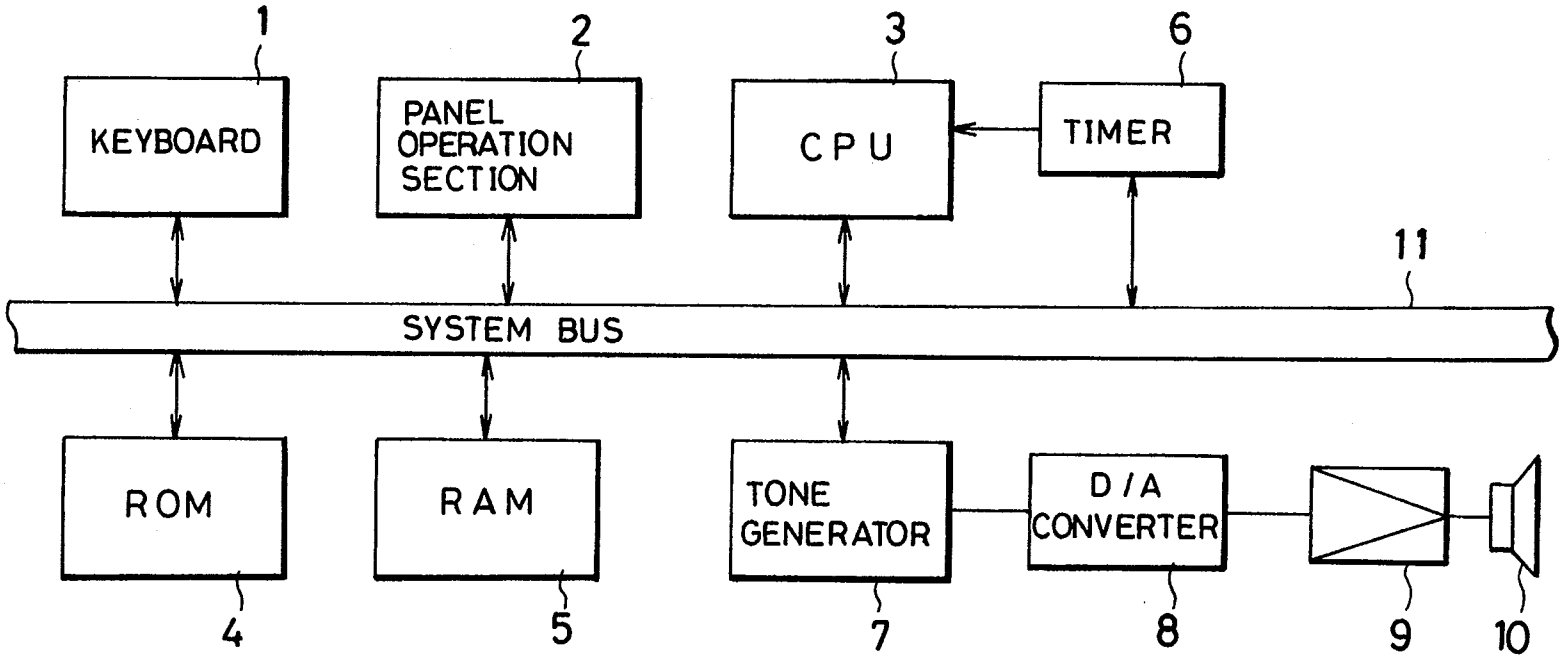
FIG. 1 is a block diagram illustrating the structure of one embodiment of an electronic musical instrument where the present invention is applied.

FIG. 1 is a schematic block diagram illustrating the general structure of an electronic musical instrument where an automatic playing apparatus according to the present invention is applied.

Referring to FIG. 1, a keyboard 1 includes multiple keys and a key scan circuit (neither shown) for detecting the depression status of each key. The key scan circuit detects the key code and touch data of a key newly depressed and the key code of a key newly released, and outputs them. The touch data is prepared by a well-known touch sensor (not shown).

A panel operation section 2 includes various switches, such as a mode switch, a melody select switch, and a rhythm select switch, and a display which displays predetermined information. ( Those switches and the display are not shown. ) The various switches include a demonstration switch (hereafter referred to as "demo switch") directly concerning the feature of the present invention.

The demo switch is used to instruct the start/stop of playing a demo. In other words, the demo playing starts when the demo switch is turned on, and the demo playing is stopped with the demo switch turned off.

The set/reset status of each switch on the panel operation section 2 is to be detected by a built-in panel scan circuit (not shown), as in the case of the keyboard 1. The panel scan circuit checks the statuses of the individual switches on the panel operation section 2 to detect any panel switch which is set ON, and sends the detection result to a central processing unit (CPU) 3.

The CPU 3 controls individual sections of the electronic musical instrument in accordance with a control program which is stored in a program memory in a ROM 4.

Stored in the ROM 4 are demo data and other various fixed data in addition to the control program to operate the CPU 3.

A random access memory (hereafter referred to as "RAM") 5 stores the demo data temporarily, stores status information of the electronic musical instrument, or serves as a work area for the CPU 3.

An initial value according to a tempo is set to a timer 6, which interrupts the CPU 3 at an interval corresponding to the set value. Generally, the interruption to the CPU 3 is set to occur every 1/48 of one beat of a quarter note. With the interruption taken as a trigger, a tone-ON timing is calculated. The demonstration on the automatic playing apparatus embodying the present invention is also played according to this tone-ON timing.

A tone preparing circuit (tone generator) 7 generates a digital tone signal under the control of the CPU 3. The digital tone signal from the tone generator 7 is supplied to a D/A converter 8.

The D/A converter 8 converts the digital tone signal into an analog tone signal, which is then supplied to an amplifier 9.

The amplifier 9 amplifies the analog tone signal by a predetermined gain. The output of the amplifier 9 is supplied to an acoustic circuit 10.

The acoustic circuit 10 converts the analog tone signal as an electric signal into an acoustic signal. The acoustic circuit 10 is acoustic generating means typified by a loudspeaker or a headphone.

The keyboard 1, the panel operation section 2, the CPU 3, the ROM 4, the RAM 5, the timer 6 and the tone generator 7 are connected to one another by a system bus 11.

Figure 2:
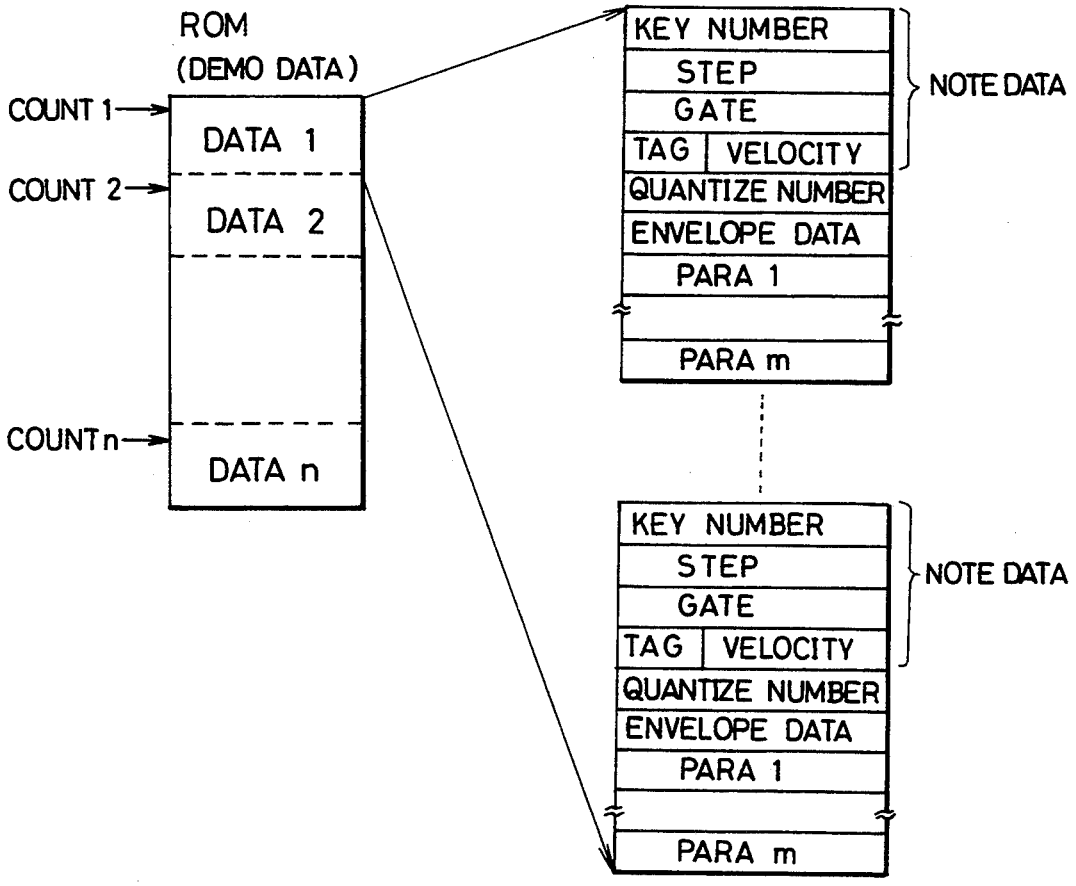
FIG. 2 is a diagram showing the format of demo data according to one embodiment of the present invention.

FIG. 2 illustrates the format of demo data to be stored in the ROM 4. The demo data to be used by the automatic playing apparatus of the present invention includes a quantize number, envelope data, and other parameters PARA1 to PARAm, besides note data which is included in conventional demo data.

The quantize number is information which causes a slight shift in the normal position and the normal length of a note which vary with a change in time. Changing the quantize number delicately alters the image of music. The envelope data is information for controlling the amplitude of a tone wave. Altering the envelope data provides a sustain sound or an attenuating sound. The parameters PARA1 to PARAm are data, such as timbre data and rhythm data, which can affect the image of the music, like the quantize number and the envelope data. In the claims that follow, the quantize number, envelope data, and parameters PARA1 to PARAm are collectively and generically referred to as "parameter information." As stated earlier, it is the variation in these parameters that causes a change in the mental image created by the music each time a musical piece is replayed so that the listeners do not become bored. It should be understood, however, that the change in parameters causes the sound, form, or over-all content of the music to actually change, i.e., the change in mental image is caused by physical changes in the sound waves produced by the acoustic generating means 10. Thus, the term "image" should be understood on two levels, i.e., the internal level where it refers to a mental image or impression, and the external level where it refers to the over-all sound produced by said acoustic generating means.

N sets of the thus structured demo data, from data 1 to data n, are stored for every music image in the ROM 4.

The operation of the automatic playing apparatus with the above-described structure will now be described referring to flowcharts in FIGS. 3 and 4.

Figure 3:
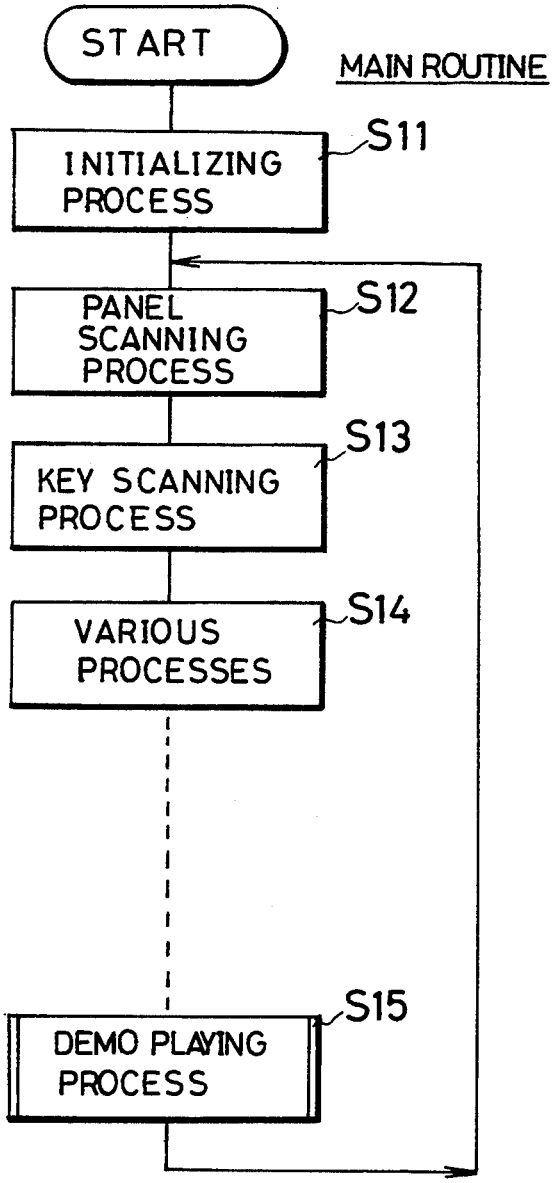
FIG. 3 is a main flowchart illustrating the operation of the embodiment of the present invention.

FIG. 3 is a flowchart showing the main routine of the electronic musical instrument to which the automatic playing apparatus of the present invention is applied.

When the apparatus is powered on, the CPU 3 executes an initializing process (step S11), and initializes data such as volume and timbre. When the keyboard 1 is operated immediately after the power is on, therefore, a musical tone is released with predetermined timbre and volume.

The CPU 3 then executes a panel scanning process (step S12). The statuses of the switches on the panel operation section 2 are scanned, and data indicating ON/OFF status of each switch is fetched into the CPU 3. The data from the panel operation section 2 is used to determine a process to be performed later according to each switch, for example, a process of altering the timbre.

The CPU 3 then executes a key scanning process (step S13). The key scan circuit scans the keyboard 1 and data indicating the depression/release status of each key on the keyboard 1 is latched in the CPU 3. This data is used in a tone-ON process and tone-OFF process, both to be performed later.

In accordance with the data acquired through the panel scanning process (step S12) and the key scanning process (step S13), the CPU 3 then executes various processes (step S14). In other words, various processes, such as the timbre altering process, tone-ON process and tone-OFF process, are performed in accordance with the statuses of the switches on the panel operation section 2 or the depression/release statuses of the keys on the keyboard 1. The details of these processes do not directly concern the subject matter of the present invention, and their explanation will not therefore be given.

The subroutine of a demo playing process is called (step S15).

Figure 4:
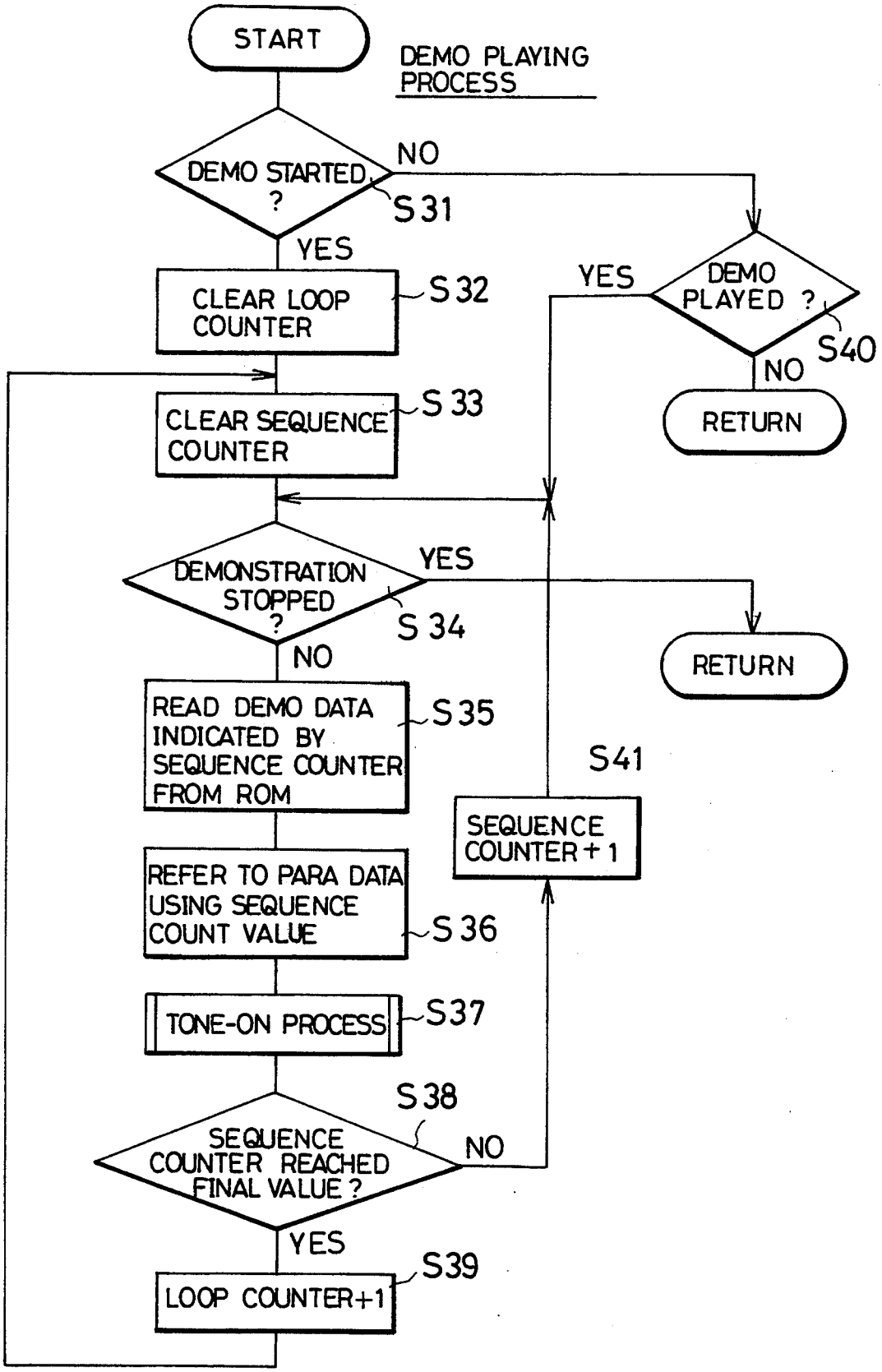
FIG. 4 is a flowchart showing a demo playing process in FIG. 3.

FIG. 4 presents a flowchart showing the demo playing process.

In the demo playing process, it is first determined if demo playing should be started (step S31). In other words, based on the data acquired from the panel scanning process in step S12 of the main routine, it is determined whether the demo switch of the panel operation section 2 has been set ON. When the demo switch is not judged to have been set ON, it is determined if the demo is now being played (step S40). This judgment is made referring to a demo play flag (not shown) defined in the RAM 5. The demo play flag is to be set when the demo switch is rendered ON, and it is to be reset when the demo switch is set OFF.

When it is not judged in step S40 that the demo playing is in progress, the flow returns from the subroutine to step S12 in the main routine, and the same sequence of processes as described previously will be performed again.

When it is judged in step S40 that the demo playing is in progress, the flow advances to step S34. The processes following this step 34 will be explained later.

When it is judged in step S31 that the demo playing should start, the demo play flag is set and a loop counter is cleared (step S32). The loop counter counts the number of times the demo is played so that a player can check later how many times the demo has been played.

A sequence counter is then cleared (step S33). The sequence counter counts the status of reading demo data prepared for every music image (data 1 to data n in FIG. 2), i.e., the progression of the demo playing. When the sequence counter is initialized, the demo data stored in the ROM 4 is read out from the beginning, i.e., from the data 1.

It is then determined if the demo playing should be stopped (step S34). In other words, it is determined if the demo switch of the panel operation section 2 has been turned off. If the demo switch is judged to have been set OFF, the demo play flag is reset, and the flow returns from the subroutine to step S12 in the main routine to perform the same sequence of processes as described earlier. The demo playing will be stopped unfinished by the process in step S34.

If it is judged in step S34 that the demo should continue, the demo data indicated by the sequence counter is read out from the ROM 4 (step S35). A predetermined bias is added to the value of the sequence counter. As the ROM 4 is accessed using the resultant value, the PARA data (including the quantize number, the envelope data and the parameters PARA1 to PARAm) are referred to (step S36). Based on the PARA data, the tone-ON process is performed (step S37). The demo is to be played with the music image according to the PARA data which have been referred to.

Then, it is determined whether or not the value of the sequence counter has reached the final value (step S38). If the value of the sequence counter has not reached the final value, the value is incremented (step (S41). The flow then returns to step S34 to successively play a demo carrying a different image of music next.

If it is judged in step S38 that the sequence counter has reached the final value, the value of the loop counter is incremented (step S39), and the flow returns to step S33. The demo is therefore played again from the first demo data (data 1).

To further clarify the feature of the present invention, the demo playing on the automatic playing apparatus embodying the present invention will be explained, in comparison with demo playing on an ordinary automatic playing apparatus.

Figure 5:
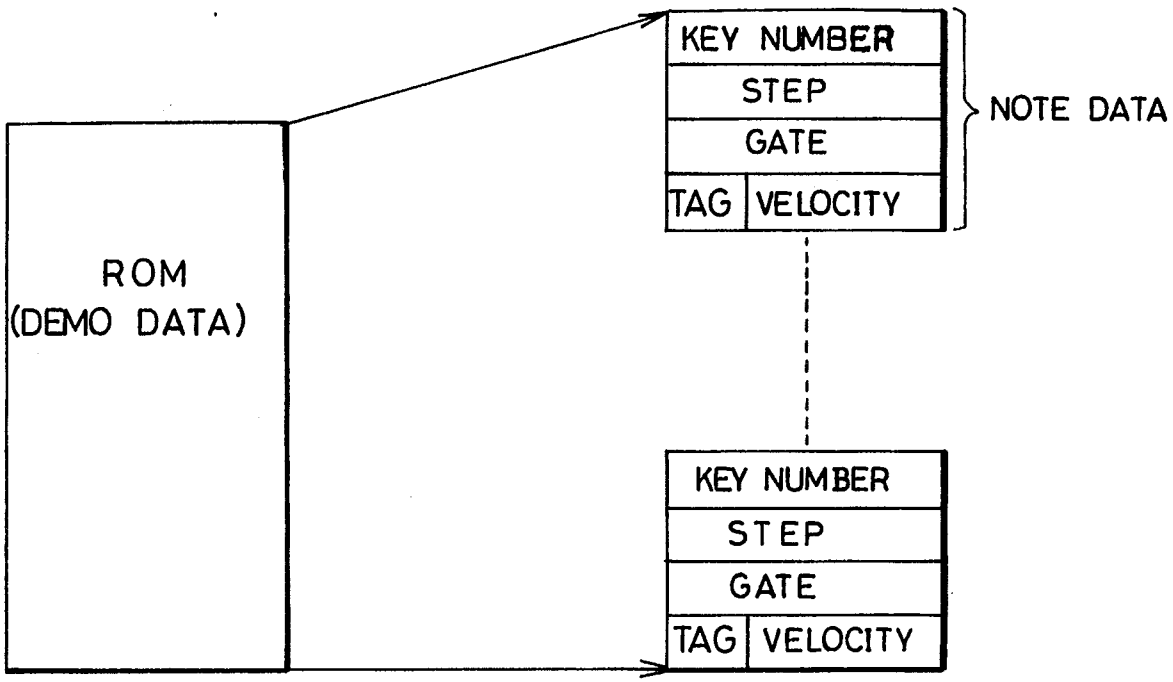
FIG. 5 is a diagram for explaining the format of demo data for an ordinary automatic playing apparatus.

FIG. 5 shows an example of the format of general demo data to be stored in the ROM. The general demo data includes multiple pieces of note data each consisting of the minimum information required for tone generation.

One piece of note data in the demo data consists of, for example, the key number, the step time, the gate time, the TAG and the velocity as already described earlier.

At the time a demo is played, the note data stored in the ROM is read out piece by piece and sent to the tone preparing circuit (tone generator) to play a predetermined piece of music.

With the use of the above demo data having such note data, music can be played only with a single given image. Since the demo data does not include any data for altering the music image, the demo would be played over and over with the same pitch. This inevitably makes the demo sound monotonous.

As shown in FIG. 2, by way of contrast, the automatic playing apparatus of the present invention has the quantize number, the envelope data, the parameters PARA1 to PARAm, all for changing the image of the music piece, as well as multiple pieces of demo data (data 1 to data n) for the same piece of music, each data piece including the quantize number, the envelope data and the other parameters PARA 1 to PARAm, which are prepared to provide different music images. The automatic playing apparatus of the present invention reads those pieces of data one after another to play the demo. This ensures demo playing of a piece of music with n different images of music.

As described above in detail, according to the present invention, it is possible to provide the automatic playing apparatus which can vary the timbre and the rhythm at a predetermined timing to change the image of music, so that the demonstration can be played without monotony.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus for automatically playing musical pieces, comprising:

automatic means for replaying a musical piece more than two times;

automatic means for varying said musical piece each time it is replayed so that a player's intervention is not required to cause a variation in each relay;

said automatic means for varying said musical piece each time it is replayed including a plurality of storage means for storing tone information, said tone information including note information for reproducing a musical tone and parameter information for varying said musical tone each time it is reproduced;

said parameter information including a plurality of differing parameters;

each storage means of said plurality of storage means having differing parameter information so that each automatic playback of a musical piece varies from other automatic playbacks thereof; and control means for sequentially reading out said tone information from said plurality of storage means and subjecting said read-out tone information to a tone-ON process to thereby automatically play a musical piece in a different form each time it is replayed.

2. An automatic playing apparatus according to claim 1, wherein said parameter information is a quantize number.

3. An automatic playing apparatus according to claim 1, wherein said parameter information is envelope data.

4. An automatic playing apparatus according to claim 1, wherein said parameter information is timbre information.

5. An automatic playing apparatus according to claim 1, wherein said parameter information is rhythm information.

6. An automatic playing apparatus according to claim 1, wherein said tone information is sequentially read out in a predetermined order from beginning to end, and after a final piece of tone information is read out to generate a musical tone, reading of said tone information is repeated from the beginning.

7. An automatic playing apparatus according to claim 6, further comprising counting means for counting the number of times said tone information is read out.

* * * * *